United States Patent [19]

Abe et al.

[11] Patent Number: 4,634,349

[45] Date of Patent: Jan. 6, 1987

[54] VARIABLE DISPLACEMENT FLUID PUMP

[75] Inventors: Taizou Abe, Chiryu; Kenji Tsukahara, Obu, both of Japan

[73] Assignee: Nippondenso Co., Ltd., Kariya, Japan

[21] Appl. No.: 808,837

[22] Filed: Dec. 12, 1985

[30] Foreign Application Priority Data

Dec. 13, 1984 [JP] Japan ..... 59-264260

[51] Int. Cl.[4] ..... F04B 1/06

[52] U.S. Cl. ..... 417/219; 92/12.1

[58] Field of Search ..... 417/220, 221, 273, 219; 91/498; 92/12.1

[56] References Cited

U.S. PATENT DOCUMENTS 2,646,755 7/1953 Joy ..... 91/498

3,636,819 1/1972 Tobias ..... 91/498

FOREIGN PATENT DOCUMENTS 8304284 12/1983 World Int. Prop. O. ..... 417/273

*Primary Examiner*—Carlton R. Croyle

*Assistant Examiner*—Paul F. Neils

*Attorney, Agent, or Firm*—Cushman, Darby & Cushman

[57] ABSTRACT

A variable displacement fluid pump comprises a rotor rotatably disposed within a housing, an eccentric ring movable close to and apart from the rotor to change a first eccentricity between a center of an inner periphery of the eccentric ring and a fixed center of rotation of the rotor so as to vary a displacement of the pump, and a plurality of pumping chambers each having a variable volume which changes sequentially to introduce thereinto fluid from an inlet port and to discharge therefrom fluid to a discharge port as the motor rotates. The rotor is so disposed that the fixed center of rotation of the rotor is spaced apart by a predetermined second eccentricity from a locus of the center of the inner periphery of the eccentric ring towards the discharge port.

6 Claims, 7 Drawing Figures

VARIABLE DISPLACEMENT FLUID PUMP

FIELD OF THE INVENTION AND RELATED ART STATEMENT

The invention relates to a variable displacement fluid pump of the type having a rotor and an eccentric ring enclosing the rotor, in which an eccentrically between a center of the eccentric ring and a rotational center of the rotor is adjustable to control the pump displacement. Such pump is well applicable to the fuel pump which generates a higher discharge pressure.

Such pump includes a vane type pump in which a plurality of vanes are slidably received in slots formed in the rotor, and a radial piston type pump in which plunger pistons are slidably carried by the rotor. These pumps are so designed that as the rotor rotates with the vanes or plunger pistons in sliding contact with an inner periphery of the eccentric ring, a volume of a pumping chamber defined by the adjacent vanes or plunger pistons is cyclically varied to suck or discharge fluid. By varying the eccentricity between the eccentric ring and the rotor, the variation of the volume of the pumping chamber is changed to control the pump displacement. Japanese Patent Unexamined Publication No. 58-18582 discloses such vane type pump as an example.

However, these types of pump have been encountered with two conflict problems, as will be explained hereinafter with reference to the radial piston pump.

When the radial piston pump operates and the pumping chamber is communicated with the discharge chamber, a discharge pressure is applied to the plunger piston which is associated with the pumping chamber. The resultant force of the applied discharge pressures against the plunger pistons acts to reduce the eccentricity between the eccentric ring and the rotor. In consequence, the pump displacement is decreased. It is a first problem involved in the prior pump that as the discharge pressure is raised, the pump displacement is changed and not controlled sufficiently.

Furthermore, the second problem arises in a transition of the plunger piston from the suction stroke into the discharge stroke through a top dead centre (in which a volume of the pumping chamber becomes maximum, and which will be referred hereinafter to as "T. D. C."). The moment when a communication of the pumping chamber is switched from the suction chamber to the discharge chamber, the pressure in the pumping chamber is raised rapidly and stepwise by from the inlet fluid pressure to the discharge fluid pressure. This results in occurrence of pressure surges in the pumping chamber and/or abuttment of the plunger piston on the eccentric ring, which possibly causes vibration or noises in the pump.

OBJECT AND SUMMARY OF THE INVENTION

The invention, therefore, has an object to solve these problems together or simultaneously by providing the improved variable displacement pump which is capable of controlling of the pump displacement against a higher discharge pressure and avoiding the sudden rise of pressure in the pumping chamber.

The other object, features, effects, and meritorious advantages of the invention will become more clear from the following description of preferred embodiments with reference to the accompanying drawings.

DETAILED DESCRIPTION OF PREFERRED EMBODIMENTS

Figure 1:
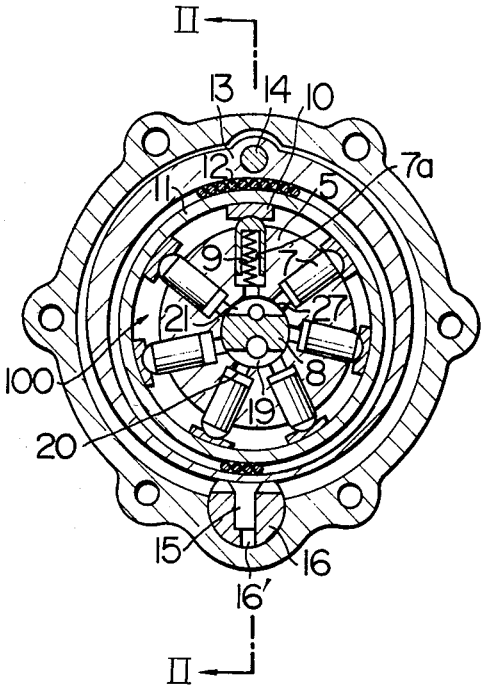
FIG. 1 is a cross sectional view of a pump according to the invention as taken along the line I—I in FIG. 2.
Figure 2:
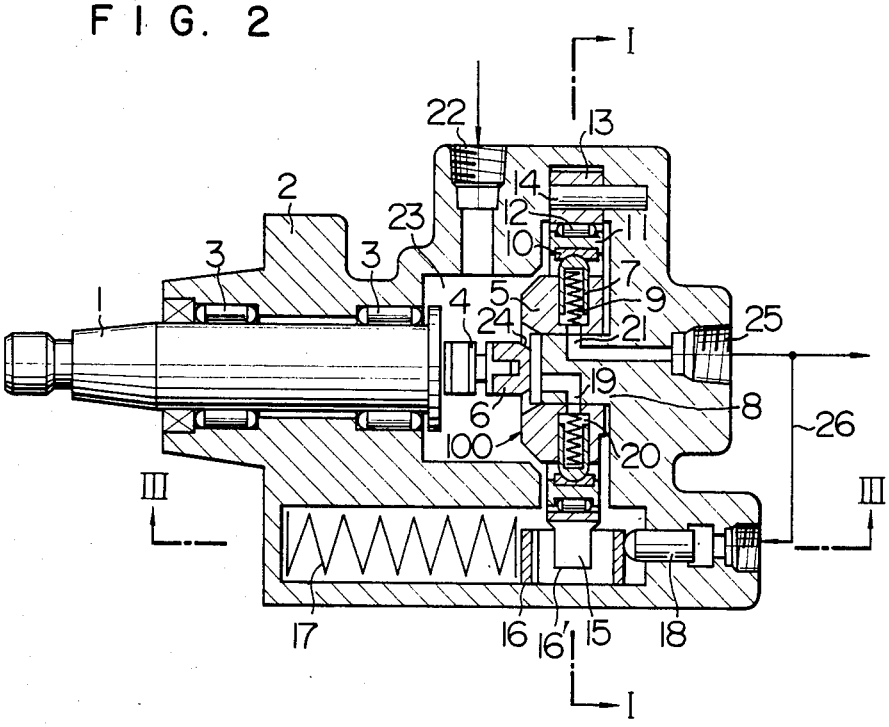
FIG. 2 is a longitudinal sectional view of the pump as taken along the line II—II in FIG. 1.

FIGS. 1 and 2 show a radial piston type pump 100 which includes a housing 2, a rotor 5 accomodated in the housing 2, and an eccentric ring 13 enclosing the rotor 5. A drive shaft 1 is journaled on bearings 3 for rotation within the housing 2. The shaft 1 is connected at one end thereof through a joint 4 to a rotor shaft portion 6 projecting from one end surface of the rotor 5, while the other end of the shaft 1 is to be connected to a drive unit (not shown).

Figure 4:
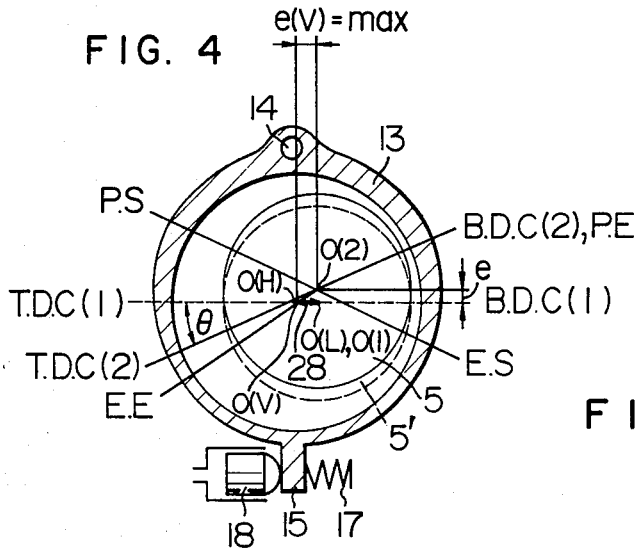

The rotor 5 carries seven plunger pistons 7 for sliding reciprocation in the respective radial bores formed in the rotor 5. The rotor rotates about an axis of a pintle 8 integrally formed with the housing 2. As shown in FIG. 4, the rotational center O(2) of the rotor 5 is apart upwardly from a locus 28 O(H)-O(L) of the center of the eccentric ring 13 at a predetermined eccentricity e which will be described later. Each plunger piston 7 is biased radial outwardly by a spring 9 housed in a recess 7*a* formed in the plunger piston 7. The disclosed end of the plunger piston 7 is kept in contact with a cam ring 11 through a shoe 10. Both of the inner and the outer peripheries of the cam ring 11 form concentric cylindrical surfaces. The cam ring 11 is so disposed within the eccentric ring 13 that the outer cylindrical surface of the cam ring 11 is rotatable relative to the ring 13 through a plurality of rollers 12 disposed therebetween. It is noted that the inner peripheries of the cam ring 11 and the eccentric ring 13 are also concentric with each other. The eccentric ring 13 is pivotably mounted at an enlarged portion thereof to the housing 2 through a pivot pin 14 secured to the housing 2 for swinging the ring 13 around an axis of the pivot pin 14.

Figure 3:
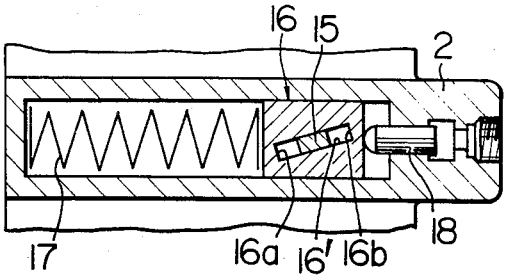
FIG. 3 is a fragmentary sectional view of the pump as taken along the line III—III in FIG. 2, FIGS. 4 and 5 are schematic views showing varied conditions of eccentricity of the eccentric ring relative to the rotor.

As the eccentric ring 13 swings, the center O(V) of the inner periphery of the ring 13 moves and then trances a locus 28 extending from O(H) to O(L). When the center O(V) is situated at O(H), an eccentricity e(V) between the center O(V) and the rotational center O(2) of the rotor 5 is maximum (see FIG. 4), while the eccentricity e(V) is reduced to zero when the center O(V) is situated at O(L) (see FIG. 5). The eccentric ring 13 is provided in a portion thereof diametrically oppose to the enlarged portion with an integrally formed plate projection 15. The plate projection 15, as shown in FIGS. 2 and 3, is slidably received in a groove or slot 16' formed in a slider 16.

The slider 16 is disposed within the housing 2 for slidable movement substantially in parallel to the axes of the rotor 5 and a spindle 8. The slot 16' and the plate projection 15 oblique at a predetermined small angle to the sliding direction of the slider 16.

The slider 16 is normally biased by a spring 17 which abuts on one end of the slider 16. Furthermore, a control plunger 18 abuts on the other end of the slider 16, to which a discharge pressure from the pump is applied. The control plunger 18 is slidable and is in alignment with the slider 16. The slider 16 is moved by a difference pressure between the pressure applied to the plunger 18 and the inverse spring pressure of the spring 17.

The operation of the above mentioned radial piston pump will now be described hereinafter.

When the rotor 5 rotates, the cam ring 11 also rotates together with the rotor 5 in the same direction due to a frictional force provided between the cam ring 11 and the shoes 10. If the center of the cam ring 11 or of the eccentric ring 13 is apart at an eccentricity e(V) from the rotational center O(2) of the rotor 5, the plunger piston 7 under the actions of the spring 9 and of the cam ring 11 reciprocates against the rotor 5 over a distance approximately twice the eccentricity e(V) per one rotation of the rotor 5.

Accordingly, when the rotor 5 rotates clockwise as viewed in FIG. 1, the fluid is sucked into the pumping chamber 20 located in a lower half zone of the pump through a suction chamber 19 provided in the spindle 8, while the pressurized fluid in the pumping chamber 20 in an upper half zone of the pump is pumped out to a discharge chamber 21 provided in the spindle 8.

Hence, the fluid introduced from a suction port 22 is pumped out towards a load (not shown) through a working chamber 23 formed in the housing 2, a communication port 24 formed in the rotor 5, the suction chamber 19, the pumping chamber 20, the discharge chamber 21 and a discharge port 25. The pumping action thus takes place. The amount of discharge per one rotation of the rotor 5 is determined according to the volumetric change of the pumping chamber 20 or the extent of reciprocating movement of the plunger piston 7, i.e. the eccentricity e(V) of the eccentric ring 13 with respect to the rotor 5. In this respect, the positions of the eccentric ring 13 and the cam ring 11 depend on the position of the slider 16 with which the plate projection 15 is in engagement.

When the pump is at rest, the slider 16 is in one of the terminal positions under the influence of the spring 17. Accordinlgy, the plate projection 15 is in contact with one side wall 16*a* of the slot 16', so that the eccentric ring 13 has a maximum eccentricity e(V)=max to the rotor 5 (FIG. 4). In this situation, the pump has a maximum displacement.

When the pump starts, the discharge pressure of fluid raises. The discharge pressure is applied to the end of the control plunger 18 through a branch line 26 to urge the slider 16 against the spring force of the spring 17. When the discharge pressure is further increased so that the the urging forced of the control plunger 18 overcomes the spring force of the spring 17, the slider 16 is moved towards the spring 17. In this instance, since the plate projection 15 is allowed to move in a direction perpendicular to the axis of the rotor 5, but is restrained from movement along an axial direction of the rotor 5, the plate projection 15 is relatively moved towards the other side wall 16*b* of the slot 16' and positioned in a blance position. The slot 16' obliques at a predetermined small angle to the sliding direction of the slider 16, so that the plate projection 15 is moved towards the control plunger 18 as viewed in FIG. 3. In consequence, the eccentric ring 13 is swung counterclockwise, so that the eccentricity e(V) is reduced and the pump displacement is also reduced. Accordingly, in case that the displacement of the pump exceeds the fluid consumption required in the load, the discharge pressure raises and the displacement of the pump is automatically reduced to balance with the fluid consumption required in the load. To the contrary, in case that the displacement of the pump is less than the required fluid consumption of the load, the discharge pressure is reduced and the eccentric ring 13 is swung clockwise, so that the displacement of the pump is raised to balance with the required fluid consumption. Namely, the discharge pressure of the pump is determined by the spring force of the spring 17 and the magnitude of the discharge pressure of the fluid applied to the control plunger 18 as the parameters.

The operation of the pump will now be described hereinafter with reference to FIGS. 4 and 5. The like or the same members are designated by the same referencial numerals as ones shown in FIGS. 1 and 2. The cam ring 11 is removed for purpose of easy explanation.

Figure 5:
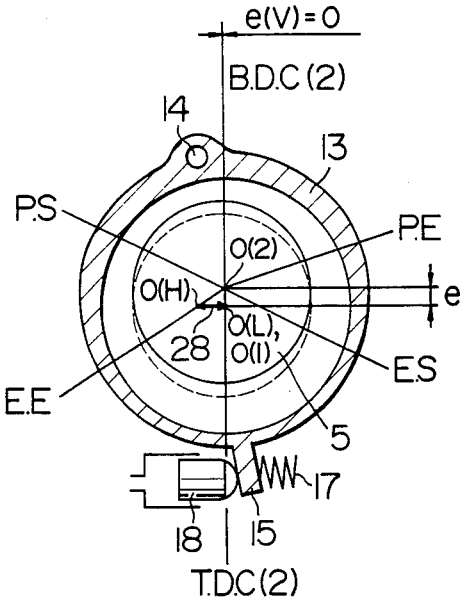

In FIGS. 4 and 5, the rotor 5 in the foregoing embodiment of the invention is indicated by a solid line circle having a center O(2) while the prior art rotor 5' is indicated by a broken line circle having a center O(1).

The O(H) and O(L) indicate a starting point and an end point of a locus 28, respectively, which is traced by the center O(V) of the eccentric ring 13 upon the swing movement of the ring 13 about the pivot pin 14. The eccentric ring 13 is so disposed within the housing that the rotational center O(2) of the rotor 5 is apart from the prior art center O(1) at a predetermined eccentricity e upwardly or in a direction perpendicular to the locus 28 towards the discharge chamber 21. The prior art center O(1) resides on the locus 28, and more generally in the point O(L). Accordingly, as the eccentric ring 13 swings about the pivot pin 14 and the center O(V) of the eccentric ring 13 moves from the point O(H) to the point O(L), the eccentricity e(V) between the center O(V) of the eccentric ring 13 and the rotational center O(2) of the rotor 5 is changed from maximum (=max) to minimum (=O) to control the displacement of the pump. FIG. 4 shows the relationship between the ring 13 and the rotor 5 in a condition in which the eccentricity e(V) is maximum, while FIG. 5 shows the relationship in a condition in which the eccentricity e(V) is minimum.

In FIGS. 4 and 5, the discharge stroke starts from a pumping start position (referred hereinafter to as "P.S") and ends with a pumping end position (referred hereinafter to as "P.E"). During the discharge stroke, the pumping chamber 20 is communicated with the discharge chamber 21. The suction stroke starts from an entering start position (referred hereinafter to as "E.S") and ends with an entering end position (referred hereinafter to as "E.E"). During the suction stroke, the pumping chamber 20 is communicated with the suction chamber 19. The top dead center (T.D.C) and a bottom dead center (in which a volume of the pumping chamber is minimum, and which will be referred hereinafter to as "B.D.C.") are determined by a positional relationship between the rotor 5 (or 5') and the eccentric ring 13 and are located on a line extending through the rotational center O(2) (or O(1)) of the rotor 5 (or 5') and the center O(V) of the eccentric ring 13. FIG. 4 shows T. D. C. (1) and B. D. C. (1) in case that the eccentricity e(V) in the prior art pump is maximum. FIG. 4 also shows T. D. C. (2) and B. D. C. (2) in case that the eccentricity e(V) of the embodiment of the invention is maximum.

In the prior art pump, the rotational center O(1) of the rotor 5' is located on the locus 28, so that T. D. C. (1) and B. D. C. (1) are stationary regardless of the movement of the eccentric ring 13. To the contrary, in the embodiment of the invention, the rotational center O(2) of the rotor 5 is apart from the locus 28 at a predetermined eccentricity e, so that T. D. C. (2) is moved from one position shown in FIG. 4 to another position shown in FIG. 5 in a direction oppose to a rotation of the rotor 5 according to the movement of the eccentric ring 13.

Figure 6:
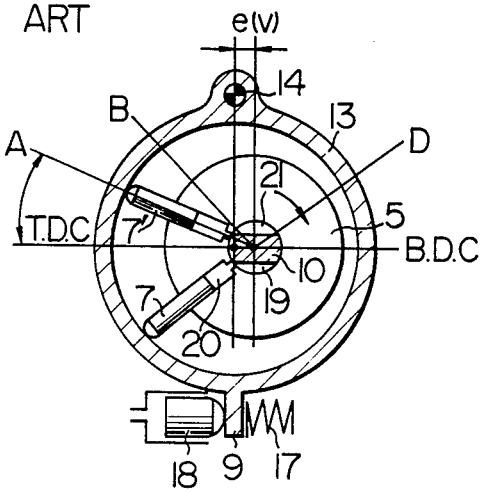
FIG. 6 PRIOR ART
FIG. 6 is a cross sectional view of a prior art pump.
Figure 7:
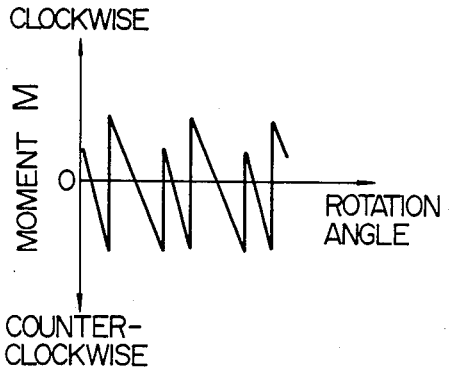
FIG. 7 is a graphic representation showing the relationship of the moment applied upon the eccentric ring to the rotational angles of the rotor.

In the prior art pump, as shown in FIG. 6, while the pumping chamber 20 is communicated with the discharge chamber 21 (between A to D), the discharge pressure is applied to the plunger piston 7 which changes the volume of the pumping chamber 20, and then the eccentric ring 13 is urged by the plunger piston 7. In consequence, the resultant force acts on the eccentric ring 13 in one direction so as to reduce the eccentricity e(V) or in the opposite direction, so that the oscillating moment M about the pivot pin 14 is generated. The magnitude of the oscillating moment M changes in dependence on the number of the pumping chamber 20 which are communicated with the discharge chamber 21 and on the rotational angle of the rotor 5. The oscillating moment M alternates the direction thereof from a clockwise to a counterclockwise, or inversely, as shown in FIG. 7. When the mean value of the oscillating moment M is deviated to the clockwise side or the counter-clockwise side, the oscillating moment M acts on both of the plunger 18 and the spring 17 as a load.

In case that the mean value of the oscillating moment M is deviated to the counter-clockwise side, as the discharge pressure of the pump is increased, the eccentric ring 13 is moved counter-clockwise side or is so moved that the eccentricity e(V) is decreased, whereby the amount of displacement is also decreased. Accordingly, as described above, raised is the problem that it is impossible to fully control the amount of the displacement of the pump in respect of the discharge pressure thereof.

To the contrary, the moment when the plunger piston 7 transits from the suction stroke to the discharge stroke through the T. D. C., i.e. the communication of the pumping chamber 20 is switched from the suction chamber 19 to the discharge chamber 21, the pressure in the pumping chamber is raised rapidly stepwise from the inlet fluid pressure to the discharge fluid pressure. This results in occurrence of pressure surges in the pumping chamber 20 and/or abuttment of the plunger piston 7 on the eccentric ring 13, which causes vibration or noises in the pump as described above.

These problems are serious in case of higher discharge pressure. Accordingly, it has been proposed that the stroke of the pumping chamber 20 between the T. D. C. and the communication position where the pumping chamber 20 comes into communication with the discharge chamber 21 is extended, i.e. the communication position is transited from the position A to the position B. This causes the fluid in the pumping chamber 20 to be pre-compressed to increase the pressure thereof and then to be discharged towards the discharge chamber 21. Accordingly the problems in noises and vibration are solved.

However, in this case, the mean value of the oscillating moment M is deviated to the counter-clockwise side and then raised is the problem that the amount of the displacement of the pump can not be fully controlled. In particular, in a higher speed range of the pump, since the pressure change in the pumping chamber 20 is occurred between the position in which the pumping chamber 20 becomes in communication with the discharge chamber 21 and the position which is shifted clockwisely over the pumping end position D, such pressure change acts on the eccentric ring 13 as a large mean counter-clockwise oscillating moment. In order to solve such problem of the oscillating moment M, it is preferable that the position in which the pumping chamber 20 becomes in communication with the discharge chamber 21 is close to the T. D. C.

As described above, these two problems are contradictory to each other and then it is impossible to solve these problems simultaneously in the prior pump.

To the contrary, according to the present invention, in case that the T. D. C. (2) is positioned among the suction stroke, i.e. between the E. S. and the E. E., the fluid is sucked into the pumping chamber 20 between the E. S. and the T. D. C. (2) from the suction chamber 19 and the fluid is returned back from the pumping chamber 20 between the T. D. C. (2) and the E. E. to the suction chamber 19. The substantial amount of fluid sucked into the pumping chamber 20 corresponds to the difference between the amount of the sucked fluid between the E. S. and the T. D. C. (2) and the amount of the returned fluid between the T. D. C. (2) and the E. E. In case that the B. D. C. (2) is positioned among the discharge stroke, i.e. between the P. S. and the P. E., the substantial amount of fluid discharged from the pumping chamber 20 corresponds to the difference between the amount of the discharged fluid between the P. S. and the B. D. C. (2) and the amount of the sucked fluid between the B. D. C. (2) and the P. E.. Accordingly, when the first eccentricity e(V) between the centers of the eccentric ring 13 and the rotor 5 is zero (even in this case, there is a predetermined second eccentricity e between the centers of the eccentric ring 13 and the rotor 5), it is possible to decrease the amount of the displacement of the pump to zero by means of locating the eccentric ring 13 in respect of the rotor 5 so that both of the substantial amounts of the sucked fluid and the discharge fluid become zero. Furthermore, even when the first eccentricity e(V) is not zero, it is also possible to decrease the amount of the displacement of the pump to zero by means of locating the eccentric ring 13 in the above mentioned manner.

The oscillating moment M which is caused by the plunger pistons 7 acting on the eccentric ring 13 is determined in dependence on the pre-compression zone and on the discharge stroke zone. Accordingly, the first eccentricity e(V) is so elected that the mean value of the oscillating moment M in the pre-compression zone and in the discharge stroke zone becomes zero or neutral. Namely, in case of the maximum first eccentricity e(V) (FIG. 4), it is supposed that an angle $\theta$ is an optimum angular transition between the position of the prior T. D. C. (1) and the position of the T. D. C. (2), the second eccentricity e is approximately determined by the following equation.

$$e = e(V) \cdot \tan \theta$$

In FIG. 4, the eccentric ring 13 is so disposed that the rotational center O(2) of the rotor 5 is apart upwardly from the eccentric ring center locus 28 along a direction perpendicular thereto by the predetermined eccentricity e. Furthermore, in case that the eccentric ring 13 is so disposed that the rotational center O(2) of the rotor 5 is apart merely upward from the eccentric ring center locus 28 by the predetermined eccentricity e, the above mentioned advantages are also obtainable.

It is obvious to those skilled in the art that the present invention is applicable not only to the above mentioned radial piston pump but to the vane type pump.

Furthermore, the present invention is applicable to the pump in which the eccentric ring is moved linearly by a pair of control plungers, as shown in Japanese Patent Unexamined Publication Nos. 57-5585 and 57-131889, and to the pump which is disclosed in Japanese Patent Unexamined Publication No. 57-73881. In these cases, the same advantages as the present invention can be obtained. In case that the present invention is applied to the above mentioned pump, the eccentricity e is so determined that the result of the forces acting onto the eccentric ring is directed to a direction perpendicular to the direction of linear movement of the eccentric ring.

As described above, according to the present invention, the eccentric ring is so disposed that the rotational center of the rotor is located upwardly form the eccentric ring center locus and is apart from the eccentric ring center locus by a predetermined eccentricity e towards the discharge chamber. Accordingly, the position of the T. D. C. is transited in respect of the discharge chamber in a direction in inverse to the direction of rotation of the rotor. Namely, the angular distance between the position of the T. D. C. and the position in which the pumping chamber becomes in communication with the discharge chamber is enlarged. Accordingly, the fluid in the pumping chamber is pre-compressed and then the pre-compressed fluid is discharged from the pumping chamber to the discharge chamber, whereby the noises and/or vibration in the pump is reduced efficiently. Furthermore, if the predetermined eccentricity e is so selected that the mean value of the forces acting on the eccentric ring becomes minimum, the eccentric ring is remained in a steady state and the displacement of the pump is fully controlled. According to the present invention, the meritorious advantages, i.e. substantial reduction of the noises and the vibration of the pump and accurate control of the displacement of the pump, are obtained by the simple constructions of the pump in which the eccentric ring is so disposed that the center of the rotor is located upwardly from the eccentric ring center locus and is apart from the eccentric ring center locus by a predetermined eccentricity e towards the discharge chamber.

According to the tests conducted by the inventors, the noises in the high discharge pressure pump is decreased by about 10 dB(A).

What is claimed is:

1. A variable displacement fluid pump comprising:

a housing provided therein with a working chamber, said housing having a fluid inlet port and a fluid discharge port;

a rotor disposed within said working chamber of said housing for rotation about a fixed center of rotation;

a plurality of pumping chambers radially provided in said rotor;

an inlet chamber provided in said housing in communication with said fluid inlet port, said inlet chamber being successively communicated with said pumping chambers upon rotation of said rotor;

a discharge chamber provided in said housing in communication with said discharge port, said discharge chamber being successively communicated with said pumping chambers upon rotation of said rotor;

an eccentric ring disposed radially outwards from said rotor, said eccentric ring being movable within said housing in a first direction perpendicular to an axis of said eccentric ring so that a first eccentricity between a center of an inner periphery of said eccentric ring and said fixed center of rotation of said rotor is adjustable, whereby a displacement of said fluid pump is variable, and said eccentric ring being disposed in said housing so that said fixed center of rotation of said rotor is apart by a second eccentricity from said center of the inner periphery of said eccentric ring in a direction perpendicular to said first direction towards a communication portion between at least one of said pumping chambers a volume of which is reducing and said discharging chamber, whereby a volume of said one pumping chamber which just becomes in incommunication with said inlet chamber is further reduced to pre-compress the fluid in said pumping chamber upon rotation of said rotor; and means for biasing said eccentric ring to adjust said first eccentricity.

2. A pump according to claim 1, wherein said second eccentricity is determined so as to minimize a component of an urging force acting onto said eccentric ring in a direction along which the center of the inner periphery of said eccentric ring parts from said fixed center of rotation of said rotor, which urging force is generated by change of pressure in said pumping chambers.

3. A pump according to claim 1 wherein each pumping chamber is defined by a radial recess formed in the outer periphery of said rotor and a plunger piston which is fluid tightly and slidably received within said recess partially, said plunger piston being so provided and arranged within said recess that an end portion of which protrudes from said outer periphery of said rotor acts onto the inner periphery of said eccentric ring.

4. A pump according to claim 3, wherein said pump further comprises a cam ring which is interposed between said eccentric ring and said rotor, and a plurality of shoes each provided between said end portion of said plunger piston and the inner periphery of said eccentric ring.

5. A pump according to claim 1, wherein said eccentric ring is pivotably mounted at an enlarged portion thereof onto said housing, and said eccentric ring is provided at a portion thereof diametrically opposite to said enlarged portion with a plate projection which engages with said biasing means.

6. A pump according to claim 5, wherein said biasing means comprises a compression spring means and a plunger which is so disposed that an axis of said plunger is in alignment with an axis of said spring means and that said plate projection is interposed between said spring means and said plunger, and wherein said first eccentricity is controlled by a pressure difference between a spring force of said spring means and a fluid pressure applied to said plunger.

* * * * *